United States Patent [19]

Jackson et al.

[11] Patent Number: 4,684,481

[45] Date of Patent: Aug. 4, 1987

[54] ELECTRO-CONDUCTIVE ELASTOMERIC MATERIALS

[75] Inventors: John Jackson, Lesmahagow; Seyed A. Angadjivand, Kelvindale, both of Scotland

[73] Assignee: University of Strathclyde, Glasgow, Scotland

[21] Appl. No.: 821,279

[22] Filed: Jan. 22, 1986

[30] Foreign Application Priority Data

Jan. 29, 1985 [GB] United Kingdom ..... 8502202

[51] Int. Cl.[4] ..... H01B 1/06

[52] U.S. Cl. ..... 252/510; 252/511

[58] Field of Search ..... 252/511, 502, 510; 524/495, 496

[56] References Cited

U.S. PATENT DOCUMENTS 4,505,847 3/1985 Jackson ..... 252/511

4,533,604 8/1985 Honda et al. ..... 252/510

*Primary Examiner*—Josephine L. Barr

*Attorney, Agent, or Firm*—Bell, Seltzer, Park & Gibson

[57] ABSTRACT

A method of manufacturing an electro-conductive elastomeric material comprises the steps of mixing together a silicone polymer gum such as type C2501, graphitic carbon particles such as 55 micron particle size, a curing agent such as Silester O.S., and a cross-linking agent such as DBTL in the presence of a mesogenic oil which is synthetic, unsaturated, and has two oleic chains. The preferred oil is di-oleyl-oxalate.

9 Claims, 3 Drawing Figures

ELECTRO-CONDUCTIVE ELASTOMERIC MATERIALS

This invention relates to electro-conductive elastomeric materials, and to methods of production thereof.

In our EPC Patent Specification No. 89843 there are disclosed various electro-conductive elastomeric materials formulated from a silicone polymer gum (which is non-conductive), graphitic carbon particles (which are conductive) and unsaturated glyceride oils in the form of vegetable oils having a carbon chain length of at least 16 and a high degree of masogenicity (i.e. ability to flex around the molecular bonds). Whilst the physical and electrical properties of these disclosed materials are adequate for the purposes proposed in that Patent Specification it has been considered desirable to enhance these characteristics and to render production of these materials less dependent upon the harvesting of naturally occurring vegetable oils.

According to the present invention there is provided a method of manufacturing an electro-conductive elastomeric material comprising the steps of mixing together a silicone gum, graphitic carbon particles, curing and crosslinking agents in the presence of a mesogenic oil wherein the oil is synthetic, unsaturated, and has two oleic chains.

Preferably the oil is di-oleyl oxalate (which is liquid at room temperature).

Preferably also the method is carried out in the presence of a volatile additive in which the oil and gum dissolve and/or disperse miscibly.

Preferably also the additive volatilises at a rate which equates to the rate of curing of the mixture.

Conveniently the mixture vulcanises at room temperature.

By virture of the present invention the electro-conductive elastomeric material is rendered independent of harvesting of naturally-occurring vegetable oils and improved physical and electrical characteristics are achieved in comparison with those attainable utilising the previously preferred vegetable oil, namely arachis oil.

An embodiment of the present invention will now be described by way of example with reference to the accompanying drawings, in which.

Figure 1:
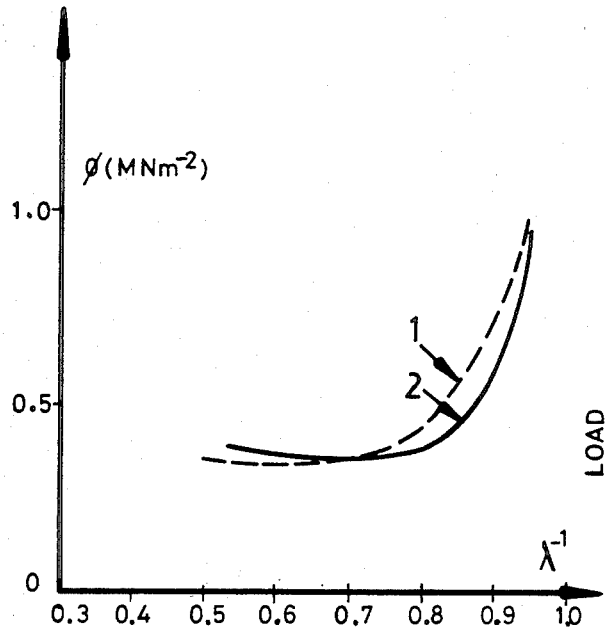
FIG. 1 illustrates comparative physical characteristics of electro-conductive elastomeric materials manufactured in accordance with the present invention and as previously proposed.

In order to synthesise the preferred synthetic oil in accordance with the present invention, 1 Mole of oleylalcohol was dissolved in 60 ml of Toluene and the solution was placed in an ice bath. When the solution had cooled 2 mole of pyridine was added and mixed into the solution. Thereafter, to the cooled solution, there was added dropwise 1 mole of oxalyl chloride dissolved in 50 ml of Toluene. The final mixture was refluxed for 4 hours and thereafter filtered to remove salts formed by the chemical reaction and toluene then evaporated from the filtrate to leave the required oil product - di-oleyl oxalate. To enhance the purity of the oil the product was distilled under vacuum.

The synthetic oil produced has a formula

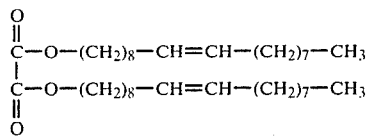

from which it can be observed that the oil is unsaturated, has two oleic chains, each chain has 18 carbon atoms, and the oil is mesogenic primarily because of the C=C bond within the oxalic moiety.

In accordance with the method described in the aforesaid EPC Patent Specification an electro-conductive composition was compounded utilising 100 g silicone polymer gum (C2501), 20 g oil (di-oleyl-oxalate), 70 g graphitic carbon, 5 g crosslinker (Silester OS) and 2 g curing agent (DBTL) and the composition cut into sample sizes and tested. The results demonstrated that the ultimate tensile strength was 0.63 M $Nm^{-2}$ the elongation at break was 81.4% and the volume resistivity was 0.11 Ωm. The comparable figures for 16 g arachis oil substituted for the 20 g synthetic oil are 0.62 M $Nm^{-2}$; 98% and 0.06Ωm.

A Mooney Plot of the comparable physical characteristics of the two samples, respectively containing arachis oil and the synthetic oil is shown in FIG. 1, it being understood that a Mooney Plot is a well known technique for representing the physical characteristics of an elastomeric material where the ordinate axis (Y-axis) denotes the function $\phi$ where $$\phi = \frac{\text{Force } (F)}{\text{Area of } X - \text{Sec } (A) \times (\lambda - \lambda^{-2})}$$

where elongation $\lambda = l_1 l_0$, $l$ and $l_0$ being the lengths of the tested sample in the deformed and undeformed states respectively.

It will be observed that the Mooney Plot of the material incorporating the synthetic oil (graph 2) is very similar to that (graph 1) for the material incorporating arachis oil (which is a vegetable oil) and essentially the illustrated physical characteristics are the same for the two materials.

Figure 2:
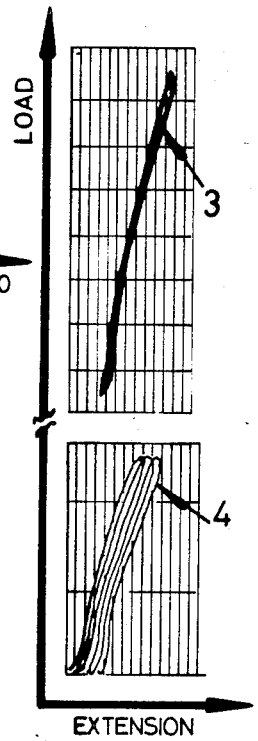
FIG. 2 illustrates other comparative physical characteristics of the electro-conductive elastomeric materials manufactured in accordance with the present invention and as previously proposed.

Furthermore, FIG. 2 illustrates the hysteresis curves generated by comparable samples when subjected to load cycling tests using a load of 0.1 Kg, Crosshead speed of 100 cm/min and chart speed of 50 cm/min. In this case each sample utilised 100 g silicone polymer gum of the type 'Polymer B as made and sold by ICI under the product code 11636 instead of gum C2501 in order to eliminate any possible influence of the fumed silica filler contained in gum C2501. It can be seen that the synthetic oil sample (graph 3) exhibits less hysteresis during load cycling tests than does the arachis oil sample (graph 4).

Figure 3:
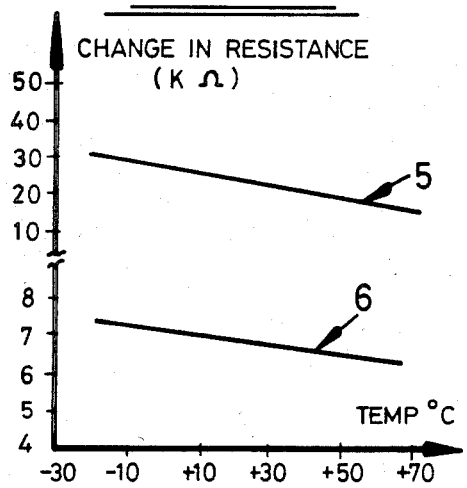
FIG. 3 illustrates electrical characteristics of the materials referred to in FIG. 1.

As regards electrical characteristics of the samples referred to with reference to FIG. 1 the effect of temperature variation is depicted in FIG. 3 from which it can be seen that the arachis oil sample (graph 5) had a resistance change value of the order of 30 kΩ whereas the synthetic oil sample (graph 6) had a resistance change value of the order of 7 kΩ and additionally the latter displays less dependance upon temperature. It will be appreciated that the resistance change referred to is that between the resistance of the sample in the undeformed state and the resistance of the sample in its fully deformed state.

What is claimed is:

1. A method of manufacturing a cured and cross-linked silicone polymer electro-conductive elastomeric material comprising the steps of selecting as constituents for the electro-conductive material a silicone polymer gum, graphitic carbon particles, curing and cross-linking agents and a mesogenic oil which is synthetic, unsaturated, of the oxalic moiety, and has two oleic chains, forming an intimately mixed admixture of said constituents, and subsequently subjecting the admixture to settled conditions over a predetermined time interval to effect cross-linking and curing of the admixture.

2. The method claimed in claim 1, wherein the oil is initially dissolved and/or dispersed miscibly in a volatile additive prior to being mixed with the silicone polymer gum, graphitic carbon particles, curing and cross-linking agents.

3. The method claimed in claim 2, wherein the constituents of the admixture are qualitatively selected so that the volatile additive has a volatilization rate substantially equal to the rate of curing of the admixture.

4. The method claimed in claim 3, wherein said volatile additive is Toluene.

5. The method claimed in claim 1, wherein the oil has two oleic chains having a carbon chain length of at least 16.

6. The method claimed in claim 5, wherein the oil is di-oleyl oxalate.

7. A method as claimed in claim 1, wherein the constituents of the mixture and their relative proportions are:

100g silicone polymer gum
20g di-oleyl-oxalate (oil)
70g graphitic carbon particles
5g Silester O.S. (cross-linker)
2g Dibutyl Tin Dilaurate (curing agent)

8. An electro-conductive elastomeric material when manufactured by the method of claim 1.

9. An electro-conductive elastomeric material when manufactured by the method of claim 7.

* * * * *